US006314952B1

(12) United States Patent
Turin et al.

(10) Patent No.: US 6,314,952 B1
(45) Date of Patent: Nov. 13, 2001

(54) INDIVIDUAL CYLINDER FUEL CONTROL METHOD

(75) Inventors: Raymond Claude Turin, Royal Oak; Sanjeev Manubhai Naik, Sterling Heights, both of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/535,006

(22) Filed: Mar. 23, 2000

(51) Int. Cl.[7] ..... F02D 41/14
(52) U.S. Cl. ..... 123/673; 123/674; 701/109
(58) Field of Search ..... 123/672, 673, 123/674; 701/109

(56) References Cited

U.S. PATENT DOCUMENTS

| | | | |
|---|---|---|---|
| 4,962,741 | 10/1990 | Cook et al. | 123/489 |
| 5,462,037 | 10/1995 | Hasegawa et al. | 123/673 |
| 5,548,514 | 8/1996 | Hasegawa et al. | 364/431.05 |
| 5,566,071 | 10/1996 | Akazaki et al. | 364/431.05 |
| 5,623,913 | 4/1997 | Kitajima et al. | 123/673 |
| 5,732,689 | 3/1998 | Ohno et al. | 123/673 |
| 5,758,630 | 6/1998 | Maki et al. | 123/673 |
| 6,148,808 * | 11/2000 | Kainz | 123/673 |

* cited by examiner

*Primary Examiner*—Erick Solis
(74) *Attorney, Agent, or Firm*—George A. Grove; Jeffrey A. Sedlar

(57) ABSTRACT

An improved individual cylinder fuel control method based on sampled readings of a single oxygen sensor responsive to the combined exhaust gas flow of several engine cylinders. A model-based observer is used to reproduce the imbalances of the different cylinders and a proportional-plus-integral controller is used for their elimination. Both the observer and the controller are formulated in terms of a periodic system. The observer input signal is preprocessed such that it reflects at each point of time the deviation from the current A/F-ratio mean value calculated over two engine cycles. Therefore, transient engine operating conditions do not harm the reconstruction of the cylinder imbalances dramatically. The control algorithm features process/controller synchronization based on table lookup and a mechanism to automatically adjust the mapping between the observer estimates and the corresponding cylinders if unstable control operation is detected.

6 Claims, 3 Drawing Sheets

INDIVIDUAL CYLINDER FUEL CONTROL METHOD

TECHNICAL FIELD

This invention relates to fuel control of a multi-cylinder internal combustion engine, and more particularly a control for carrying out individual cylinder fuel control with a single exhaust gas oxygen sensor.

BACKGROUND OF THE INVENTION

Effective emission control of internal combustion engine exhaust gases with a catalytic converter requires precise control of the air/fuel ratio supplied to the engine cylinders. For this purpose, it is customary to install an oxygen sensor in the engine exhaust pipe, and to use the sensor output as a feedback signal for closed-loop fuel control. Typically, the exhaust gases of several engine cylinders are combined in an exhaust manifold with a single oxygen sensor positioned near the outlet, and an average reading of the oxygen sensor is used as a common feedback signal for controlling the fuel supplied to the several cylinders. This approach assumes a uniform air and fuel distribution among the several cylinders. However, there are frequently significant variations in air and fuel distribution among different cylinders, due to manufacturing tolerances (e.g., intake ports and fuel injectors), pressure resonance oscillations (intake manifold and fuel rail), and inhomogeneous EGR distribution. These variations cause the actual air/fuel ratio to significantly depart from the target air/fuel ratio, which tends to degenerate emission control, limit high dilution (lean burn) engine operation, deteriorate fuel economy, and possibly cause misfires.

For this reason, it has been proposed to individually trim the fuel pulse width for each engine cylinder; see, for example, the U.S. Pat. No. 5,651,353, issued on Jul. 29, 1997, and U.S. Pat. No. 5,732,689, issued on Mar. 31, 1998. Some systems of this type utilize multiple oxygen sensors for developing air/fuel ratio feedback signals unique to each cylinder. Other systems use only a single oxygen sensor for reduced cost, and utilize a mathematical model or observer to correlate the sensor readings with a given cylinder.

The model-based approach involves two basic steps: (1) recovering the cylinder imbalance pattern from the single oxygen sensor signal, and (2) mapping the recovered imbalance pattern to individual engine cylinders for purposes of trimming the individual fuel pulse widths. The first step typically involves a model-based observer which captures the dynamics of both the engine and the oxygen sensor. In a strictly time-based domain, there exist two essentially different modeling practices yielding a device to recover the cylinder imbalances from the raw oxygen sensor signal. One practice is based on transforming the rotational dynamics of the engine into a non-periodic representation using a "lifting technique". As a result of this transformation, the imbalances pertaining to the N different cylinders are represented by one particular observer state variable, each. Thus, the entire set of state variables captures the entire imbalance pattern over one engine cycle in a time-invariant fashion. The engine can then be balanced through individually feeding each of the recovered imbalances back to the corresponding cylinder. For each cylinder, an individual feedback loop is thus required. Alternatively, according to the second practice, the periodicity of the engine may be preserved in terms of a periodic observer in which the cylinder imbalances are shifted in a cyclic manner through the entire set of state variables. Thus, at each instant of time, the entire imbalance pattern over one full engine cycle, as generated in accordance with the cylinder firing sequence, is captured by the entire set of state variables. The controller dynamics are also modeled as a periodic system, thus lending hand to the implementation of a feed-back structure with one single loop only. The second step of mapping the recovered imbalances to the individual engine cylinders can be difficult because un-modeled process dynamics and delays give rise to a phase shift in the measurement signal which is difficult to assess in advance, and which also varies with the engine operating point. In the case of the non-periodic representation, the phase shift is manifested as an offset between the N observer state variables and the corresponding cylinders. In other words, the phase offset is represented by an integer index having value (0, 1, . . . N−1) that relates each engine cylinder to a particular recovered imbalance number. This is illustrated in FIG. 1A for a four cylinder engine, where the observer state variables are identified as $x_1$–$x_4$, and the offset has a value of two; for example, state variable $x_1$ is related to cylinder number three, and state variable $X_3$ is related to cylinder number one, etc. In the case of the periodic representation, the phase shift directly reflects the time delay between the original cylinder imbalance pattern and the recovered imbalance pattern captured in the sequence of the N observer state variables at each sampling instant. The time delay is expressed in terms of the number of sampling times and, therefore, is again characterized by an integer index having value (0, 1, . . . N−1). As illustrated in FIG. 1B, the mapping is realized by selecting that observer state variable as the input to the periodic controller, which is indicated by this number in terms of an offset with respect to first state variable. For example, by feeding-back the first state variable if the index is zero, by feeding-back the second state variable if it is one, etc.

To achieve stable individual cylinder control over an extended range of engine operating conditions, this index value can be determined for various engine operating points and stored in a look-up table, for example, as a function of engine speed and load. However, because the dynamic characteristics (i.e., the time constants and hence the phase shifts) of the engine may change over time, some of the data contained in the lookup table may become inappropriate. Therefore, it is important to monitor the operation of the control system and take corrective actions if necessary.

SUMMARY OF THE INVENTION

The present invention is directed towards an improved individual cylinder fuel control method based on sampled readings of a single oxygen sensor responsive to the combined exhaust gas flow of several engine cylinders. According to the invention, a model-based observer is used to reproduce the imbalances of the different cylinders and a proportional-plus-integral controller is used for their elimination. Both the observer and the controller are formulated in terms of a periodic system. The observer input signal is preprocessed such that it reflects at each point of time the deviation from the current A/F-ratio mean value calculated over two engine cycles. Therefore, transient engine operating conditions do not harm the reconstruction of the cylinder imbalances dramatically. The control algorithm features process/controller synchronization based on table lookup and a mechanism to automatically adjust the mapping between the observer estimates and the corresponding cylinders if unstable control operation is detected.

BRIEF DESCRIPTION OF THE DRAWINGS

FIG. 3 is a flow diagram illustrating a probing method for determining phase offset, while FIG. 4 is a flow diagram of the overall control method.

DESCRIPTION OF THE PREFERRED EMBODIMENT

Figure 1A:
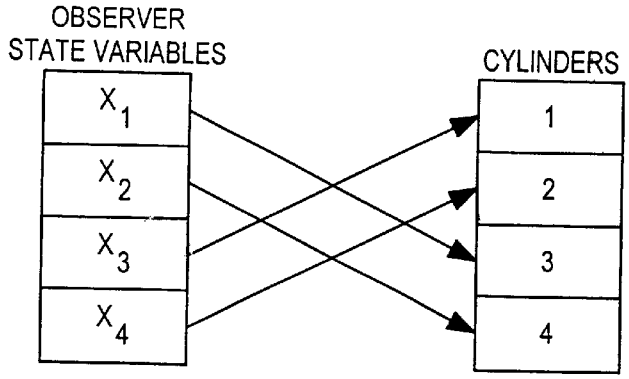
FIG. 1A is a mapping diagram for a time-invariant representation of cylinder fueling imbalances.
Figure 1B:
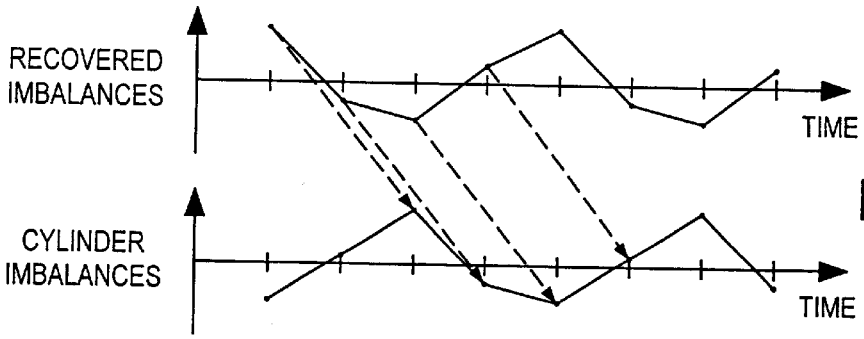
FIG. 1B is a mapping diagram for a periodic representation of cylinder fueling imbalances.
Figure 2:
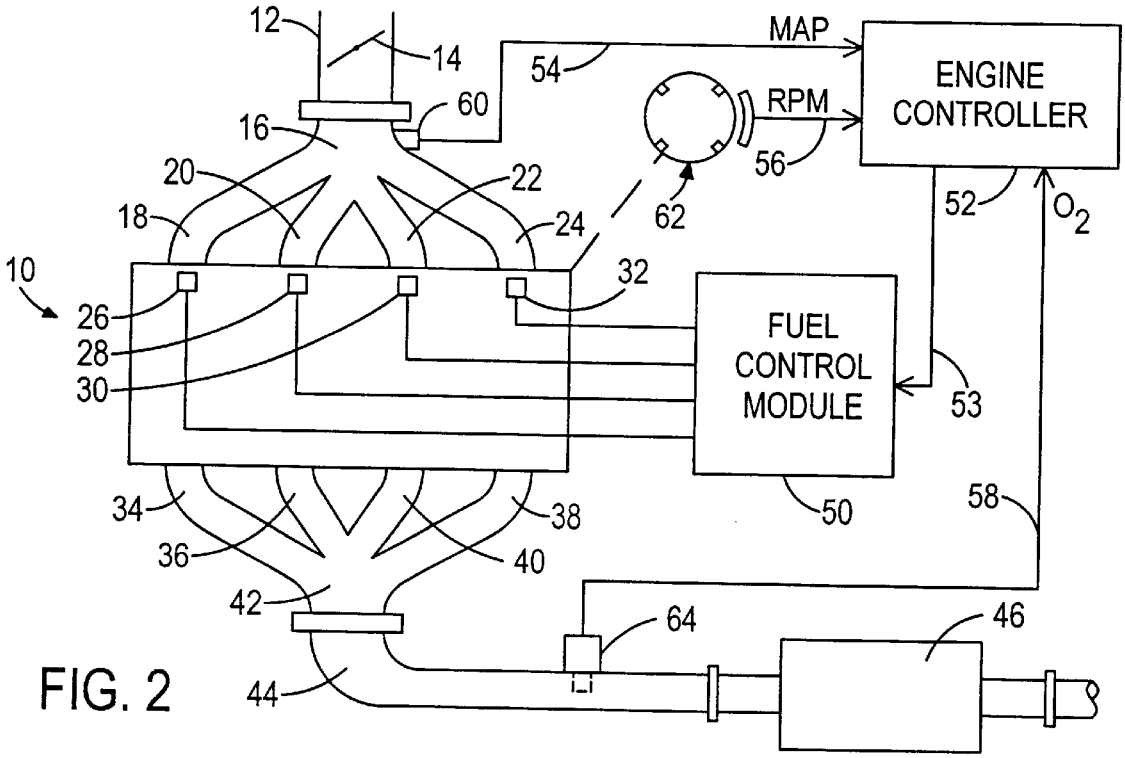
FIG. 2 is a schematic diagram of an internal combustion engine and exhaust system according to this invention, including an electronic engine control module.

Referring to the drawings, and particularly to FIG. 2, the reference numeral 10 generally designates an automotive four-cylinder internal combustion engine. Engine 10 receives intake air through an intake passage 12 that is variably restricted by a moveable throttle valve 14. Downstream of throttle valve 14, the intake air enters an intake manifold 16 for distribution to the individual engine cylinders (not shown) via a plurality of intake runners 18–24. The fuel injectors 26–32 are positioned to deliver a predetermined determined quantity of fuel to each intake runner 18–24 for combination with the intake air and admission to respective engine cylinders for combustion therein. The combustion products from each cylinder are exhausted into respective exhaust runners 34–40 of an exhaust manifold 42, and combined at a point of confluence 43 in an exhaust pipe 44, which in turn, is coupled to a catalytic converter 46 for emission control purposes.

The fuel injectors 26–32 are electrically activated by a fuel control module 50 under the control of a microprocessor based engine controller 52. Specifically, the controller 52 develops a fuel command pulse width, or injector on-time, for each of the engine cylinders, and provides the pulse width commands to fuel control module 50 via line 53, and the fuel control module activates the injectors 26–32 accordingly. The fuel pulse widths are determined in response to a number of inputs, including a manifold absolute pressure (MAP) signal on line 54, an engine speed (RPM) signal on line 56, and an oxygen sensor ($\Phi_S$) signal on line 58. The MAP signal is obtained with a conventional pressure sensor 60 responsive the pressure of the intake air in intake manifold 16, and the RPM signal may be obtained from a conventional crankshaft or camshaft sensor, generally designated by the reference numeral 62. The $\Phi_S$ signal is obtained from a conventional wide range exhaust gas oxygen sensor 64 that provides an output voltage that varies in amplitude about a DC offset voltage in relation to the deviation of the sensed exhaust gas from a stoichiometric air/fuel ratio.

In general, the engine controller 52 determines a base fuel pulse width as a function of the RPM and MAP signals, and other inputs such as temperature and barometric pressure. Alternatively, the base fuel pulse width may be determined based on a measure of mass air flow in the intake passage 12, using a mass air flow meter up-stream of throttle plate 14. The controller 52 then adjusts the base fuel pulse width using previously learned closed-loop corrections, which are typically stored in a electrically-erasable non-volatile look-up table of controller 52 as a function of RPM and MAP. In a global type of fuel control, the adjusted base fuel pulse width is then supplied to the fuel control module 50, which activates each of the injectors 26–32 (either sequentially or concurrently) for an on-time corresponding to the adjusted base fuel pulse width. In an individual cylinder fuel control according to this invention, however, the controller 52 develops cylinder-specific fuel pulse widths by determining a correction factor for each cylinder and applying the correction factors to the adjusted base fuel pulse width. In the case of a four-cylinder engine, for example, the controller 52 supplies four cylinder-specific fuel pulse widths to fuel control module 50, which activates the individual fuel injectors 26–32 accordingly.

As indicated above, the key in individual cylinder fuel control based on a single wide range oxygen sensor is being able to recover the cylinder imbalances and associate sampled sensor signals with the exhaust gasses of an individual cylinder. Once the association is determined, individual cylinder correction factors are determined to form cylinder specific fuel pulse widths. The reconstruction of engine fueling imbalances from the signal $\Phi_S$ is based on the assumption that there are individual exhaust packages associated with each cylinder firing, and that each exhaust package has a characteristic impact on the $\Phi_S$ signal. Thus, the $\Phi_S$ signal provides a filtered version of the original imbalance sequence reflecting both the mixing of adjacent packages occurring in the exhaust pipe and the dynamics inherent in the sensing process.

The sensor dynamics are modeled as a first order process having an empirically determined time constant $\tau_S$. The sensor model is given as:

$$\frac{d}{dt}\Phi_s(t) = \frac{1}{\tau_s}\{\Phi_s(t) + \Phi_{mix}(t)\} \tag{1}$$

where $\Phi_{mix}(t)$ denotes the A/F ratio at the sensor location and $\Phi_S(t)$ is the A/F ratio indicated by sensor 64. The value of $\Phi_{mix}(t)$ is dependent on the degree of mixing between the exhaust gas packages of the different cylinders. If $\Phi(t)$ denotes the A/F ratio in the exhaust package of the most recently firing cylinder at time t, and $\Delta t$ denotes the time interval $(t_i - t_{i-1})$ between two engine firing events, $\Phi_{mix}(t)$ can be modeled as:

$$\Phi_{mix}(t) = \sum_{i=1}^{N} c_i(t)\cdot\Phi(t-(i-1)\cdot\Delta t) \tag{2}$$

where N is the number of firing events over one engine cycle and $c_i(t)$ is a set of coefficients that weigh the influence of the exhaust packages occurring in the one engine cycle. Typically, $c_1(t)$ has the highest value and $c_N(t)$ the lowest value, meaning that the most recent exhaust package over one engine cycle contributes most and the oldest contributes least to $\Phi_{mix}(t)$.

Because the engine inherently operates in an event-based mode it is useful to formulate the complete exhaust mixing and sensing model in discrete-time notation. With $k_S = \exp\{-\Delta t/t_S)\}$, $\Delta t = t_k - t_{k-1}$, and under consideration of equation (2), the discrete-time version of equation (1) is:

$$\Phi_s(t_k) = k_s\Phi_s(t_{k-1}) + (1-k_s)\sum_{i=1}^{N} c_i\Phi(t_{k-i}) \tag{3}$$

Since the sampling events $t_k$ coincide with the cylinder firing events, the weighting factors $c_i(t)$ remain constant from one engine cycle to the next. However, the sampling interval $\Delta t = t_k - t_{k-1}$ varies in accordance with the time interval between two subsequent firing events.

If $\xi(t_k)$ denotes the uncorrected A/F ratio of the cylinder which fires at time $t_k$ and $\upsilon(t_k)$ denotes the corresponding fuel pulse width trim factor, then the actual A/F ratio $\Phi(t_k)$ at sampling event $t_k$ during steady state engine operation may be expressed as:

$$\Phi(t_k)=\xi(t_k)\cdot\nu(t_k) \tag{4}$$

Equations (3) and (4) represent the target system for the controller design with $\nu(t_k)$ as the input and $\Phi_S(t)$ as the output variable. Wall-wetting and intake manifold dynamics can be neglected as long as the changes in the trim factor $\upsilon(t_k)$ are slow compared to the time constants of the wall-wetting and the manifold dynamics. However, equations (3) and (4) do not account for any delays occurring in the real process. Accordingly, it is useful to define a nominal or average A/F trajectory of a balanced engine, and to define the observer variables in terms of their deviation from the nominal trajectory. The nominal trajectory over two engine revolutions is identified by the terms $\Phi^*$, $\xi^*$, $\upsilon^*$, and is defined as follows:

$$\Phi^*(t_k)=\frac{1}{2N}\sum_{i=k-N}^{k+N-1}\Phi_s(t_i),\ \xi^*(t_k)=\Phi^*(t_k),\ \upsilon^*(t_k)=1 \tag{5}$$

This nominal trajectory is essentially a filtered version of the measured A/F ratio, and enhances those constituents of the measured A/F ratio that contain the cylinder imbalance pattern, while attenuating those constituents attributable to noise and transient engine operation. The observer deviation variables $\psi_s(t_k)$, $\psi(t_k)$, $x(t_k)$, $u(t_k)$ are then defined as:

$$\begin{aligned}
\psi_s(t_k)&=\Phi_s(t_k)-\Phi^*(t_k)\\
\psi(t_k)&=\Phi(t_k)-\Phi^*(t_k)\\
x(t_k)&=\xi(t_k)-\xi^*(t_k)\\
u(t_k)&=\upsilon(t_k)-\nu^*
\end{aligned} \tag{6}$$

where $\psi_s(t_k)$ is the sensed A/F ratio imbalance, $\psi(t_k)$ is the actual A/F ratio imbalance, $x(t_k)$ is the original cylinder A/F ratio imbalance, and $u(t_k)$ is the trim signal, assuming slow changes in $\Phi^*$ and an engine operating condition close to stoichiometry. Equation (4) may then the expressed in terms of equations (6) for one distinct cylinder as follows:

$$\psi(t_k)=x(t_k)+u(t_k) \tag{7}$$

By the same token, using the definitions given in equations (6) and introducing $$\varphi_{mix}(t_{k-1})=\sum_{i=1}^{N}c_i\varphi(t_{k-i}) \tag{8}$$

from equation (2), the sensor dynamics equation (3) can be expressed as follows:

$$\psi_S(t_k)=k_S\psi_S(t_{k-1})+(1-k_S)\psi_{mix}(t_{k-1}) \tag{9}$$

Obviously, the infinite sequence of cylinder imbalances $x(t_k)$ in equation (7) is periodic with period N; i.e., $x(t_k)=x(t_{k-N})$. The sequence can be generated by applying the following recursive procedure:

$$\begin{aligned}
&x_1(t_k)=x_N(t_{k-1})\\
&x_2(t_k)=x_1(t_{k-1})\\
&\quad\vdots\\
&x_N(t_k)=x_{N-1}(t_{k-1})\\
&x(t_k)=x_1(t_k)\qquad x_i(0)=\bar{x}_i\quad i=1,\cdots,N
\end{aligned} \tag{10}$$

where $\bar{x}_i$ is the uncorrected imbalance of the ith cylinder. Equation (10) implies that each state variable $x_i$ assumes each cylinder imbalance in a repetitive pattern with a period of one engine cycle. Furthermore, all state variables have identical patterns but the pattern of each variable is shifted with respect to the previous variable by one sampling event. That is, each state variable $x_i(t_k)$ reflects at one particular sampling point the imbalance of one particular cylinder and at the next sampling point the imbalance of the succeeding cylinder (in terms of the firing sequence) and so on. Thus, the time series captured in each component of equation (10) reflects the periodically varying equivalence ratio pattern at the confluence point 43 in the exhaust pipe 44 for the case that the trim variables $u(t_k)$ are zero. Of course, a representation similar to equation (10) can be found to characterize the periodicity of the required trim variables:

$$\begin{aligned}
&u_1(t_k)=u_N(t_{k-1})+\Delta u(t_{k-1})\\
&u_2(t_k)=u_1(t_{k-1})\\
&\quad\vdots\\
&u_N(t_k)=u_{N-1}(t_{k-1})\\
&u(t_k)=u_1(t_k)\qquad u_i(0)=0\quad i=1,\cdots,N
\end{aligned} \tag{11}$$

The term $\Delta u(t_{k-1})$ denotes the trim adjustment or the control input needed to gradually balance the cylinders. Obviously, $\Delta u(t_{k-1})=0$ for balanced cylinders.

Defining $\psi_i(t_k)=x_i(t_k)+u_i(t_k)$, $i=1,\ldots,N$, and summing the components of equations (10) and (11), respectively, it follows from equation (7) that:

$$\begin{aligned}
&\varphi_1(t_k)=\varphi_N(t_{k-1})+\Delta u(t_{k-1})\\
&\varphi_2(t_k)=\varphi_1(t_{k-1})\\
&\quad\vdots\\
&\varphi_N(t_k)=\varphi_{N-1}(t_{k-1})\\
&\varphi(t_k)=\varphi_1(t_k)
\end{aligned} \tag{12}$$

Equation (12) describes the behavior of the A/F ratio imbalances as perceived at the confluence point 43 of the exhaust system. From equations (8), (9) and (12), the following overall system representation can be obtained:

$$\begin{aligned}
&\varphi_1(t_k)=\varphi_N(t_{k-1})+\Delta u(t_{k-1})\\
&\varphi_2(t_k)=\varphi_1(t_{k-1})\\
&\quad\vdots\\
&\varphi_N(t_k)=\varphi_{N-1}(t_{k-1})
\end{aligned} \tag{13}$$

-continued $$\varphi_s(t_k) = k_s\varphi_s(t_{k-1}) + (1-k_s)\sum_{i=1}^{N} c_i\varphi_i(t_{k-1})$$

Introducing $\underline{\psi}(t_k)=[\psi_1(t_k) \ldots \psi_N(t_k)\psi_S(t_k)]^T$, equation (13) can be expressed in vector notation as $$\underline{\psi}(t_k)=A\underline{\psi}(t_{k-1})+B\Delta u(t_{k-1})$$

$$y(t_k)=\psi_S(t_k)=C\underline{\psi}(t_k) \tag{14}$$

where $A\epsilon R^{(N+1)\times(N+1)}$, $B\epsilon R^{(N+1)\times 1}$, $C\epsilon R^{1\times(N+1)}$, and $$A = \begin{bmatrix} 0 & 0 & \cdots & 0 & 1 & 0 \\ 1 & 0 & \cdots & 0 & 0 & 0 \\ 0 & 1 & \ddots & \vdots & \vdots & \vdots \\ \vdots & & \ddots & 0 & 0 & 0 \\ 0 & & & 1 & 0 & 0 \\ c_1(1-k_s) & c_2(1-k_s) & \cdots & c_{N-1}(1-k_s) & c_N(1-k_s) & k_s \end{bmatrix},$$

$$B = \begin{bmatrix} 1 \\ 0 \\ \vdots \\ 0 \end{bmatrix}, C = [0 \cdots 01].$$

Equation (14) represents a dynamic model for those A/F ratio excursions in the exhaust gas which are solely due to cylinder imbalances, and provides a convenient basis for the design of an observer to recover the A/F-ratio imbalances appearing in the exhaust gas packages. Although equation (14) implies that the trim variable is an inherent part of the plant, the fuel controller requires the trim input in the form of equation (4); hence $$\upsilon(t_k)=f_{avg}+u(t_k)=f_{avg}+u_N(t_{k-1})+\Delta u(t_{k-1}) \tag{15}$$

where $f_{avg}$ denotes a multiplier which allows for adjusting the average A/F-ratio setpoint.

It is assumed that the trim adjustment $\Delta u(t_k)$ is relatively small compared to the cylinder imbalances. Thus, the input term in equation (14) can be omitted for the observer design. With $$\hat{\underline{\varphi}}(t_k) \in R^{N+1}$$

denoting an estimate of $\psi(t_k)$ and $\hat{A}=A-\Delta A$ where $\Delta A$ represents modeling errors associated with the sensor and the mixing dynamics, i.e., $$\hat{A} = \begin{bmatrix} 0 & 0 & \cdots & 0 & 1 & 0 \\ 1 & 0 & \cdots & 0 & 0 & 0 \\ 0 & 1 & \ddots & \vdots & \vdots & \vdots \\ \vdots & & \ddots & 0 & 0 & 0 \\ 0 & & & 1 & 0 & 0 \\ \hat{c}_1(1-\hat{k}_s) & \hat{c}_2(1-\hat{k}_s) & \cdots & \hat{c}_{N-1}(1-\hat{k}_s) & \hat{c}_N(1-\hat{k}_s) & \hat{k}_s \end{bmatrix}, \tag{16}$$

$$\Delta A = \begin{bmatrix} 0 & \cdots & 0 \\ \vdots & & \vdots \\ 0 & \cdots & 0 \\ \Delta a_{N+1,1} & \cdots & \Delta a_{N+1,N+1} \end{bmatrix}$$

the following general state-space representation for the observer can be found:

$$\hat{\underline{\varphi}}(t_k) = \hat{A}\hat{\underline{\varphi}}(t_{k-1}) + K[y(t_{k-1}) - C\hat{\underline{\varphi}}(t_{k-1})]$$

$$= [\hat{A} - KC]\hat{\underline{\varphi}}(t_{k-1}) + Ky(t_{k-1}) \tag{17}$$

$$\hat{y}(t_k) = C\hat{\underline{\varphi}}(t_k)$$

The constant Kalman gain vector $K\epsilon R^{N+1}$ is calculated according to $$K=MC^TS^{-1} \tag{18}$$

where $M\epsilon R^{(N+1)\times(N+1)}$ is computed iteratively from $$M=P-PC^T(CPC^T+S)^{-1}CP$$

$$P=\hat{A}M\hat{A}^T+Q \tag{19}$$

Strictly speaking, the matrices $S\epsilon R$ and $Q\epsilon R^{(N+1)\times(N+1)}$ reflect statistical properties of the input and output signals of the real process. In the present context, however, they are merely used as design parameters for the filter.

Equation (11) implies that integral control action is required to avoid steady state cylinder trim errors. In the present approach a simple proportional-plus-integral (PI) controller is designed to meet this requirement. The controller is given as $$z_1(t_k) = z_N(t_{k-1}) + e(t_k) \tag{20}$$

$$z_2(t_k) = z_1(t_{k-1})$$

$$\vdots$$

$$z_N(t_k) = z_{N-1}(t_{k-1})$$

$$u(t_k) = -k_i z_1(t_k) - k_p e(t_k)$$

where $u(t_k)$ determines the control input to the engine injection system (see equation (15)), and $e(t_k)$, reflects the A/F ratio imbalance appearing in the exhaust package of that cylinder which is linked to the variable $u(t_k)$.

Introducing the vector components $u_1(t_k)=u(t_k)$, $u_2(t_k)=u(t_{k-1})$, . . . , $u_N(t_k)=u(t_{k-N+1})$, equation (20) translates into $$z_1(t_k) = z_N(t_{k-1}) + e(t_{k-1}) \tag{21}$$

$$z_2(t_k) = z_1(t_{k-1})$$

$$\vdots$$

$$z_N(t_k) = z_{N-1}(t_{k-1})$$

$$u_1(t_k) = -k_i z_1(t_k) - k_p e(t_{k-1}) = -k_i z_N(t_{k-1}) - (k_i + k_p)e(t_{k-1})$$

$$u_2(t_k) = u_1(t_{k-1})$$

$$\vdots$$

$$u_N(t_k) = u_{N-1}(t_{k-1})$$

or in vector notation with $\underline{z}(t_k)=[z_1(t_k) \ldots z_N(t_k)]^T$ and $\underline{u}(t_k)=[u_1(t_k) \ldots u_N(t_k)]^T$ $$\underline{z}(t_k)=F\underline{z}(t_{k-1})+Ge(t_{k-1})$$

$$\underline{u}(t_k)=L\underline{u}(t_{k-1})+M\underline{z}l\ (t_{k-1})+Ne(t_{k-1}) \tag{22}$$

where F, L, $M \in R^{N \times N}$, G, $N \in R^{N \times 1}$, and, $$F = \begin{bmatrix} 0 & \cdots & 0 & 1 \\ 1 & 0 & \cdots & 0 \\ 0 & \ddots & & \vdots \\ 0 & \cdots & 1 & 0 \end{bmatrix}, L = \begin{bmatrix} 0 & \cdots & \cdots & 0 \\ 1 & 0 & \cdots & 0 \\ 0 & \ddots & & \vdots \\ 0 & \cdots & 1 & 0 \end{bmatrix}, G = \begin{bmatrix} 1 \\ 0 \\ \vdots \\ 0 \end{bmatrix},$$

$$M = \begin{bmatrix} 0 & \cdots & 0 & -k_i \\ 0 & \cdots & \cdots & 0 \\ \vdots & & & \vdots \\ 0 & \cdots & \cdots & 0 \end{bmatrix}, N = \begin{bmatrix} -(k_i + k_p) \\ 0 \\ \vdots \\ 0 \end{bmatrix}$$

Of course equation (21) is equivalent to equation (11) where $\Delta u(t_{k-1}) \equiv u_1(t_k) - u_N(t_{k-1})$. Hence $$\begin{aligned} \Delta u(t_{k-1}) &= -k_i z_N(t_{k-1}) - (k_i + k_p) e(t_{k-1}) - u_N(t_{k-1}) \\ &= U_z z(t_{k-1}) + U_u u(t_{k-1}) + V e(t_{k-1}) \end{aligned} \tag{23}$$

with $U_z$, $U_u \in R^{N \times 1}$, $V \in R$, and, $U_z = [0 \ldots 0 - k_i]$, $U_u = [0 \ldots 0 - 1]$, $V = -(k_i + k_p)$ Furthermore, the error signal $e(t_{k-1})$ can be described as $$e(t_{k-1}) = H\hat{\underline{\varphi}}(t_k) = H[\hat{A} - KC]\hat{\underline{\varphi}}(t_{k-1}) + HKy(t_{k-1}) \tag{24}$$

where $H = [\delta_{0,index} \delta_{1,index} \ldots \delta_{N,index}]$ and $\delta_{i,j}$ is the Kronecker delta, i.e., $\delta_{i,j} = 0$ for all $i \neq j$ and $\delta_{i,i} = 1$. The quantity index is an integer number between 0 and N−1. It is equal to zero if the true system is exactly represented by equation (14) but may be different in the presence of unmodeled delays and dynamics. This issue is addressed below in respect to synchronization.

With (23) and (24) the complete state-space representation of the controller is given as:

$$\begin{aligned} \underline{z}(t_k) &= F\underline{z}(t_{k-1}) + Ge(t_{k-1}) \\ \underline{u}(t_k) &= L\underline{u}(t_{k-1}) + M\underline{z}(t_{k-1}) + Ne(t_{k-1}) \\ \Delta u(t_{k-1}) &= U_z\underline{z}(t_{k-1}) + U_u\underline{u}(t_{k-1}) + Ve(t_{k-1}) \end{aligned} \tag{25}$$

with $e(t_{k-1})$ is calculated according to equation (24).

The complete compensator involves the observer and controller described in equations (17) and (25), respectively. Introducing $$\underline{\zeta}(t_k) = [\hat{\underline{\varphi}}(t_k) \underline{z}(t_k) \underline{u}(t_k)]^T,$$

the compact compensator dynamics are given as follows $$\begin{aligned} \underline{\zeta}(t_k) &= A_c\underline{\zeta}(t_{k-1}) + B_c y(t_{k-1}) \\ \Delta u(t_{k-1}) &= C_c\underline{\zeta}(t_{k-1}) + D_c y(t_{k-1}) \end{aligned} \tag{26}$$

where $$A_c = \begin{bmatrix} \hat{A} - KC & 0 & 0 \\ GH[\hat{A} - KC] & F & 0 \\ NH[\hat{A} - KC] & M & L \end{bmatrix} \in R^{(3N+1) \times (3N+1)}, \quad B_c = \begin{bmatrix} K \\ GHK \\ NHK \end{bmatrix} \in R^{3N+1}$$

$$C_c = [VH[\hat{A} - KC] U_z U_u] \in R^{3N+1}, \qquad D_c = VHK \in R$$

As mentioned above, the synchronization between the controller and the observer is a matter of identifying the variable index which determines the matrix H contained in the system matrices of (26). By synchronizing the observer and the controller in a particular way the correct mapping between the cylinders and the recovered imbalances can be established. The equation (14) represents a discrete model of a process involving both continuous time (sensor, gas flow in the exhaust manifold) and discrete time (event-driven operation of the cylinders) dynamic parts. In addition to the dynamics captured by this model the real process includes continuous transport delays which introduce a phase shift between the measurement signal and the model output. By the same token, the delays induce a phase shift between the original imbalance pattern $\psi(t_k), \psi(t_{k-1}), \ldots, \psi(t_{k-N+1})$ and the recovered pattern contained in the first N components $\hat{\psi}_1(t_k), \ldots, \hat{\psi}_N(t_k)$ of the observer state vector $$\hat{\underline{\varphi}}(t_k).$$

Figure 3:
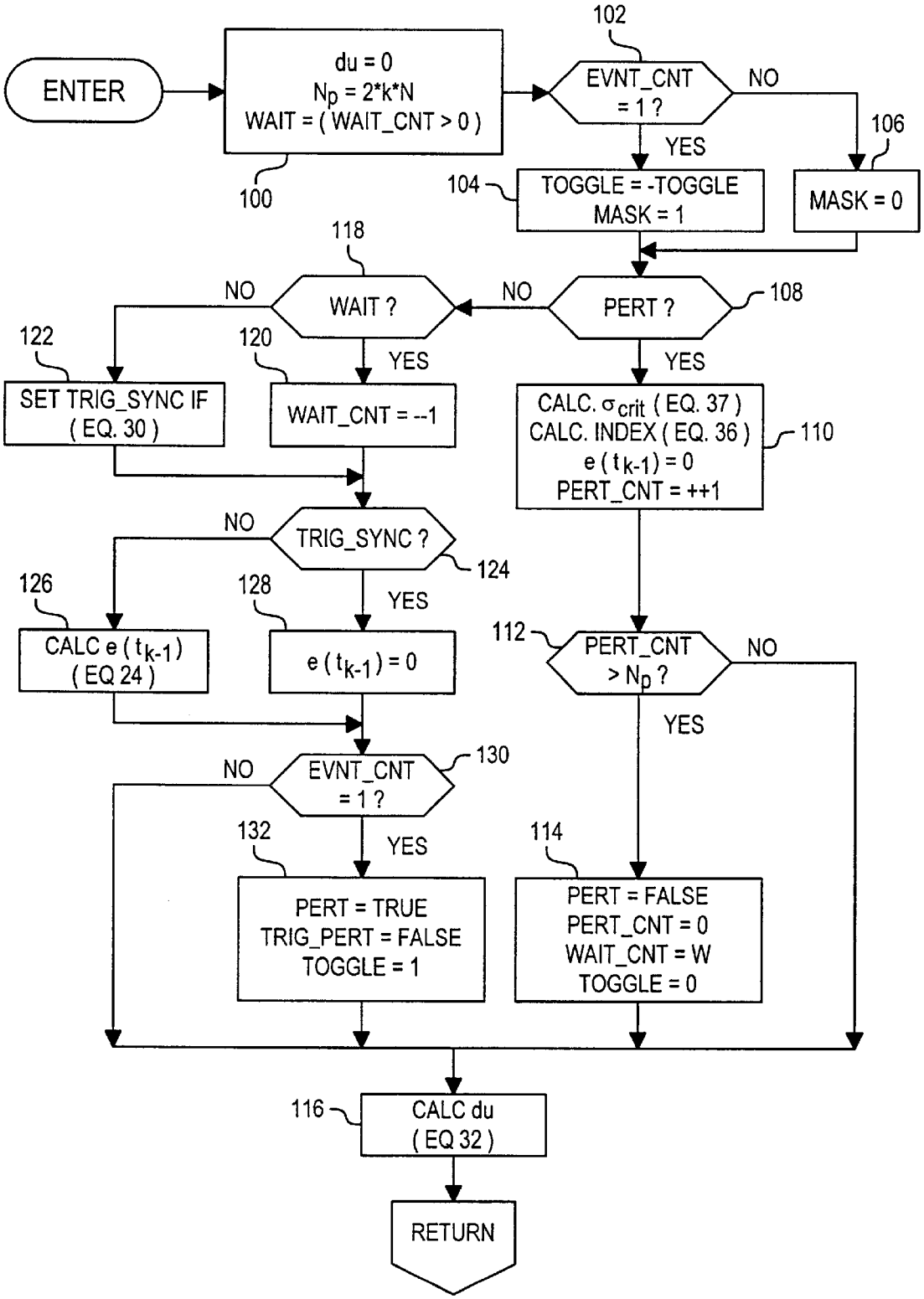
FIGS. 3–4 are flow diagrams representative of computer program instructions executed by the control module of FIG. 1 in carrying out the fuel control of this invention.

For stable individual cylinder feed-back control, however, it is imperative to identify this phase shift so that each imbalance extracted from the measurement information may be associated with its corresponding cylinder. For that matter, as illustrated in FIG. 3, it is sufficient to identify the phase shift as a fraction of the time of one period. This fraction can be expressed in terms of sampling events as a number index with $0 \leqq \text{index} \leqq N-1$. It is a characteristic parameter for each operating point and indicates that at a given time event $t_k$ the imbalance contained in component (1+index) of $$\hat{\underline{\varphi}}(t_k)$$

relates to the cylinder which is subject to the current control variable $u(t_k)$; see equation (20).

As indicated above, an important aspect of this invention involves monitoring the system performance under closed-loop control, and, if necessary, adjusting the calibration setting. To monitor the system performance consider the performance measure $$\sigma(t_k) = \sum_{i=1}^{N} |\varphi(t_{k-i+1})| \tag{27}$$

i.e., the sum of the absolute values of the exhaust package imbalances $\psi(t_k)$ over one engine cycle. Since stable individual cylinder control operation by definition implies initially decreasing and then non-increasing imbalances, the trend of the quantity represented by equation (27) can be transformed into a very sensitive stability criterion. However, the true values of the imbalances $\psi(t_k)$ are not available. Therefore, the performance measure $\sigma(t_k)$ is calculated using the estimated imbalance values provided by the observer (first N components of equation (17)), i.e.:

$$\sigma(t_k) = \sum_{i=1}^{N} |\hat{\varphi}_i(t_k)| \tag{28}$$

For any given initial cylinder imbalances stable operation of the individual cylinder control algorithm is characterized by a gradual decrease of the performance measure $\sigma(t_k)$ and vice-versa. Moreover, for stable control operation there exist a time $t_c$ and value $\sigma_{max}$ so that $$\sigma_{\max} \geq \max_{t_k}(\sigma(t_k))\forall\, t_k \geq t_c \tag{29}$$

The quantity $\sigma_{max}$ represents an upper bound of $\sigma(t_k)$ for a balanced engine which is specific for each engine operating point. Based on (28) and (29), the criterion indicating unstable control operation is now defined as follows:

$$\sigma(t_k) > k_{tol} \cdot \sigma_{crit}(t_k) \tag{30}$$

where $$\sigma_{crit}(t_k) = \begin{cases} \max(\sigma(t_k), \sigma_{\max}) & \text{if } \sigma(t_k) \leq \sigma_{crit}(t_{k-1}) \\ \sigma_{crit}(t_{k-1}) & \text{else} \end{cases} \tag{31}$$

and $k_{tol}>1$ can be thought of as a factor providing sufficient tolerance with respect to natural variations and noise components appearing in $\sigma(t_k)$.

The present invention comprehends two alternative methods of identifying the phase offset discussed above if unstable operation is indicated by the performance criterion of equation (30). According to a first embodiment, the phase offset is determined by a trial and error method involving an initial guess of the phase variable index. The control algorithm is executed under the assumption that index represents the true phase offset. If the cylinder imbalances are converging towards zero it is concluded that the initial guess was indeed correct and no action is taken. If not (that is, if the performance criteria of the control system indicates unstable operation), the offset variable index is incremented, the integrators of the controller are reset, and the control algorithm is restarted. This procedure is repeated until stable control operation is achieved. In an N cylinder engine this process involves at most N-1 erroneous trials, including the initial step.

According to a second embodiment, illustrated by the flow diagram of FIG. 3, the phase offset is determined by a probing method in which a periodic probing signal du (calculated at block 116) with $|du|=f_p$, $f_p \geqq 0$ is superposed on the control input u for one particular cylinder, and the maximal response of the recovered imbalance pattern is identified. Probing is applied during an even number $N_p$ of engine firing events, as indicated at block 100. While the system is probed the adjustment term $\Delta u$ in equation (11) is set to zero so that no undesired feedback occurs. The algorithm variables, in particular the counter variables, the logic variables, and the integrator state variables are initialized at the beginning of the engine start-up. Referring to FIG. 3, the periodic counter variable evnt_cnt (checked at block 102) is incremented on each engine event and reset after one complete engine cycle. Initially, the counter variable is equal to zero, and block 106 sets the variable mask to zero; in the next engine event, the block 104 sets mask to one, and changes the sign of the variable toggle, which is initialized to one at block 132 if the performance criterion of equation (30) indicates unstable control operation. The pert flag (checked at block 108) indicates that the algorithm is presently involved in a probing sequence. In the probing sequence, summarized in block 110, the counter variable pert_cnt is incremented to accumulate the number of engine events which have occurred during the probing intervals. When the counter reaches the reference $N_p$ (an even multiple of N; see block 100), as determined at block 112, the block 114 resets the counter variable, the pert flag, the variable toggle, and initializes a count-down variable wait_cnt. If the algorithm is not presently involved in a probing sequence, the block 118 checks the status of the wait flag, which is set at block 100 if the count in wait_cnt is positive. When the wait flag is set, block 120 decrements wait_cnt, and the performance criteria of equation (30) is evaluated at block 122 once wait_cnt has been decremented to zero, representing a certain number of sampling events. At indicated at block 122, the trig_sync flag is set if the performance criterion of equation (30) indicates unstable control operation. If the trig_sync flag is not set, as determined at block 124, the block 126 computes the error input variable $e(t_{k-1})$ using equation (24). If the trig_sync flag is set, the block 128 sets the error input variable $e(t_{k-1})$ to zero, and the block 130 checks the status of the counter variable evnt_cnt. As soon as the counter attains a value of one, the block 132 sets the pert flag, reset the trig_sync flag, and sets the variable toggle equal to one.

In the course of a probing sequence the calculation of $du(t_k)$, computed at block 116, is as follows:

$$du(t_k) = \text{mask}(t_k) \cdot \text{toggle}(t_k) \cdot f_p \tag{32}$$

where $$mask(t_k) = \begin{cases} 1 & \text{if } (evnt_cnt = 1) \\ 0 & \text{else} \end{cases}$$

and $$toggle(t_k) = \begin{cases} -toggle(t_{k-1}) & \text{if } (evnt_cnt = 1) \\ toggle(t_{k-1}) & \text{else.} \end{cases}$$

To avoid feedback actions which counteract the perturbation signal $du(t_k)$ the error input variable $e(t_{k-1})$ in equation (25) is set to zero while pert is true. Hence, during the course of a probing interval the trim signal $u(t_k)$ is given by $$\begin{aligned} z_1(t_k) &= z_N(t_{k-1}) \\ z_2(t_k) &= z_1(t_{k-1}) \\ &\vdots \\ z_N(t_k) &= z_{N-1}(t_{k-1}) \\ u(t_k) &= -k_i z_1(t_k) + du(t_k) \end{aligned} \tag{33}$$

From equation (32) it is apparent that in each of two subsequent engine cycles the mixture of the probed cylinder is shifted from lean to rich or vice-versa thus inducing a two engine cycle periodic pattern in the exhaust equivalence ratio. To recover the corresponding imbalance pattern during probing, the number of state variables in the observer equation (17) must be increased by N. Then, each N of the first 2N observer state variables capture the effect of a probing sequence with opposite probing amplitude while the last state variable again represent the sensor output. However, under normal control operation (no probing) the observer must still satisfy equation (17). To be compatible with both conditions the following observer structure is adopted:

$$\hat{\underline{\varphi}}_p(t_k) = \hat{A}_p \hat{\underline{\varphi}}_p(t_{k-1}) + K_p\left[y(t_{k-1}) - C_p \hat{\underline{\varphi}}_p(t_{k-1})\right] \tag{34}$$

-continued $$\hat{y}(t_k) = C_p \hat{\underline{\varphi}}_p(t_k)$$

where $C_p=[0 \ . \ . \ . \ 01] \epsilon R^{1\times(2N+1)}$, $K_p=[k_1 \ . \ . \ . \ k_N 0 \ . \ . \ . \ 0k_{N+1}]^T \epsilon R^{(2N+1)\times 1}$, with $k_1, \ldots, k_{N+1}$ denoting the components of K (see EQs (19),(20),(21)), and the modified system matrix $$\hat{A}_p = \begin{bmatrix} 0 & \cdots & & 0 & \delta_{no_pert} & 0 & 0 & \delta_{pert} & 0 \\ 1 & 0 & \cdots & & & & & 0 & 0 \\ 0 & 1 & 0 & & \vdots & & & \vdots & \vdots \\ \vdots & & \ddots & \ddots & & & & & \\ & & & & & \ddots & 0 & 0 & 0 \\ 0 & \cdots & \cdots & & & 0 & 1 & 0 & 0 \\ \hat{c}_1(1-\hat{k}_s) & & \cdots & & \hat{c}_N(1-\hat{k}_s) & 0 & \cdots & 0 & \hat{k}_s \end{bmatrix} \in R^{(2N+1)\times(2N+1)}$$

involves the components $$\delta_{pert} = \begin{cases} 1 & \text{if } (pert) \\ 0 & \text{else} \end{cases} \quad \text{and} \quad \delta_{no_pert} = \begin{cases} 0 & \text{if } (pert) \\ 1 & \text{else.} \end{cases}$$

The condition pert_cnt=$N_p$ (detected at block 112) marks the end point $t_{pe}$ of the probing interval. At this point (block 114) the counter variable pert_cnt is reset and the flag pert is set to false.

To obtain the required parameter index two vectors $$\underline{\phi}_1(t_k) = [\hat{\varphi}_1(t_k) \ \cdots \ \hat{\varphi}_N(t_k)]^T \quad \text{and} \quad \underline{\phi}_2(t_k) = [\hat{\varphi}_{N+1}(t_k) \ \cdots \ \hat{\varphi}_{2N}(t_k)]^T$$

containing the recovered imbalance sequences of two consecutive engine cycles at time $t_k$, respectively, and the difference vector $$d\underline{\phi}(t_k) = \underline{\phi}_2(t_k) - \underline{\phi}_1(t_k) \tag{35}$$

are introduced. The phase offset index is obtained at the end of the probing interval by identifying that row number of equation (35) containing the maximum absolute value, and subtracting one from that number, i.e., $$\text{index} = \max_i |d\phi_i(t_{pe})| - 1 \tag{36}$$

where $d\Phi_i(t_{pe})$ is the element in the ith row of $d\underline{\Phi}(t_{pe})$.

Finally, to disable rescheduling of the probing mechanism during and immediately after the end of a probing interval the threshold variable $\sigma_{crit}$ (see equation (31)) is reevaluated as follows:

$$\sigma_{crit}(t_k) = \begin{cases} \max(\sigma(t_k), \sigma_{\max}) & \text{if } ((pert) \text{ or } (wait)) \\ \sigma_{crit}(t_{k-1}) & \text{else} \end{cases} \tag{37}$$

It is important to note at this point that probing can only be applied successfully if the engine is running under steady-state operating conditions.

The previous discussion is based on the assumption that equation (36) has always a unique solution index. In practice, however, the index will change as the engine shifts from one operating point to another. Consequently, there exist operating points where adjacent components of $d\underline{\Phi}$ have the same (maximum) value, so that the evaluation of equation (37) becomes ambiguous. Of course, the engine operating envelope encompasses many different operating points where ambiguity conditions apply. Moreover, the effects of process noise extend the scope of ambiguity far beyond the range of an infinitesimally small operating region so that equation (37) may produce erroneous results any time the engine is operating close to an ambiguity point. The ambiguity problem can be mitigated to a degree of negligible statistical significance by increasing the sampling frequency such that the sensor signal is sampled at least twice per firing event. In order to capture the increased number of sampled data points comprehended in one engine event, the number of state variables in the observer is adjusted with $l=qN$, $q \epsilon N_+$ denoting the number of sampling events per engine event so that $t_j - t_{j-q} = t_k - t_{k-1} \forall j = q \cdot k$, and $t_j - t_{j-1}$ is equivalent to the time elapsing between two sampling events. In this case, the observer state vectors are given as $$\hat{\underline{\varphi}}(t_j) \in R^{l+1}$$

(without probing) and $$\hat{\underline{\varphi}}_p(t_j) \in R^{2l+1}$$

(with probing).

Without probing, and referring to equation (18), the system parameters may be modified as follows:

$$\hat{k}_s = \exp\{-(t_j - t_{j-1})/\hat{\tau}_s\} \tag{38}$$

$$\hat{A} = \begin{bmatrix} 0 & 0 & \cdots & 0 & 1 & 0 \\ 1 & 0 & \cdots & 0 & 0 & 0 \\ 0 & 1 & \ddots & \vdots & \vdots & \vdots \\ \vdots & & \ddots & 0 & 0 & 0 \\ 0 & & & 1 & 0 & 0 \\ c_1(1-\hat{k}_s) & c_2(1-\hat{k}_s) & \cdots & c_{l-1}(1-\hat{k}_s) & c_l(1-\hat{k}_s) & \hat{k}_s \end{bmatrix} \in R^{(l+1)\times(l+1)}$$

$$C = [\,0 \ \cdots \ 0 \ \ 1\,] \in R^{1\times(l+1)}$$

$$K = [\,k_1 \ \cdots \ (k_{l+1}]\,)^T \in R^{l+1}$$

where the constant Kalman gain matrix K is calculated according to equation (19), $M \epsilon R^{(l+1)\times(l+1)}$ is calculated from equation (20) with $\hat{A}$, C as described in equation (38), and $S \epsilon R$, and $Q \epsilon R^{(l+1)\times(l+1)}$. With equation (38) the basic observer (sampled q times per firing event) is given as $$\hat{\underline{\varphi}}(t_j) = [\hat{A} - KC]\hat{\underline{\varphi}}(t_{j-1}) + Ky(t_{j-1}) \tag{39}$$

$$\hat{y}(t_j) = C\hat{\underline{\varphi}}(t_j)$$

and the corresponding controller (sampled once per firing event)

$$\underline{z}(t_k) = F\underline{z}(t_{k-1}) + Ge(t_{k-1})$$

$$\underline{u}(t_k) = L\underline{u}(t_{k-1}) + M\underline{z}(t_{k-1}) + Ne(t_{k-1})$$

$$\Delta u(t_{k-1}) = U_z\underline{z}(t_{k-1}) + U_u\underline{u}(t_{k-1}) + Ve(t_{k-1}) \tag{40}$$

with $$e(t_{k-1}) = H\underline{\hat{\varphi}}(t_k),$$

$$H=[\delta_{0,index}\delta_{1,index} \cdots \delta_{l-1,index}0]\in R^{1\times(l+1)},$$

and $\delta_{i,j}$ is the Kronecker delta defined earlier.

With probing, and referring to equation (35), the system parameters may be modified as follows:

$$C_p = [\,0 \;\cdots\; 0 \;\; 1\,] \in R^{1\times(2l+1)} \tag{41}$$

$$K_p = [\,k_1 \;\cdots\; k_l \;\; 0 \;\cdots\; 0 \;\; k_{l+1}\,]^T \in R^{2l+1}$$

$$\hat{A}_p = \begin{bmatrix} 0 & \cdots & 0 & \delta_{no_pert} & 0 & 0 & \delta_{pert} & 0 \\ 1 & 0 & \cdots & & & & 0 & 0 \\ 0 & 1 & 0 & \vdots & & & \vdots & \vdots \\ \vdots & & \ddots & \ddots & & & & \\ & & & & & & & \\ & & & & \ddots & 0 & 0 & 0 \\ 0 & \cdots & \cdots & & 0 & 1 & 0 & 0 \\ \hat{c}_1(1-\hat{k}_s) & & \cdots & \hat{c}_N(1-\hat{k}_s) & 0 & \cdots & 0 & \hat{k}_s \end{bmatrix} \in R^{(2l+1)\times(2l+1)}$$

where the elements $k_i$ of $K_p$ are taken from equation (38), and $\delta_{pert}$ and $\delta_{no_pert}$ are defined as before. With equation (41) the observer (sampled q times per firing event) is given as:

$$\underline{\hat{\varphi}}_p(t_j) = [\hat{A}_p - K_pC_p]\underline{\hat{\varphi}}_p(t_{j-1}) + K_p y(t_{j-1}) \tag{42}$$

$$\hat{y}(t_j) = C_p\underline{\hat{\varphi}}_p(t_j)$$

and the corresponding controller (sampled once per firing event) is $$\underline{z}(t_k)=F\underline{z}(t_{k-1})+Ge(t_{k-1})$$

$$\underline{u}(t_k)=L\underline{u}(t_{k-1})+M\underline{z}(t_{k-1})+Ne(t_{k-1})$$

$$\Delta u(t_{k-1})=U_z\underline{z}(t_{k-1})+U_u\underline{u}(t_{k-1})+Ve(t_{k-1}) \tag{43}$$

with $$e(t_{k-1}) = \begin{cases} 0 & \text{if } (pert) \\ H_p\underline{\hat{\varphi}}_p(t_k) & \text{else,} \end{cases}$$

$$H_p=[\delta_{0,index}\delta_{1,index} \cdots \delta_{l-1,index}0 \cdots 0]\in R^{1\times(2l+1)},$$

and $\delta_{i,j}$ is the Kronecker delta defined earlier. Note that the mapping of the cylinder imbalances to the cylinders is not one-to-one anymore. Each cylinder relates to a multiple of imbalance estimates so that multiple values of the variable index provide stable individual cylinder control.

The counter variable evnt_cnt mentioned earlier counts the sampling events. It is incremented as long as it is smaller or equal to the number of sampling events per engine events 1 and reset to one otherwise. Each q sampling events conclude one firing event. Because the fuel probing input of equation (32) must retain its value over one complete firing event the variable mask is redefined as follows:

$$\text{mask}(t_k) = \begin{cases} 1 & \text{if } ((evnt_cnt = 1) \text{ or } (evnt_cnt = 2) \text{ or } \cdots \text{ or } (evnt_cnt = q)) \\ 0 & \text{else} \end{cases} \tag{44}$$

As indicated above, initial values for the phase variable index are determined by table look-up. The table is accessed in both a read and a write mode, respectively, the latter providing the capability to update the calibration based on the most recent engine data. The operating conditions are specified in terms of engine speed n and intake manifold pressure $p_m$. These two quantities constitute the axis of the lookup table. Let the two axis be defined as $axis_{p_m}=[p_{m_1} \cdots p_{m_i} \cdots p_{m_n}]$, and $axis_n=[n_1 \cdots n_j \cdots n_m]$, respectively, so that the table contains n×m table values $t_{i,j}$. Then each $t_{i,j}$ contains the value index pertaining to the operating point determined by the axis values $p_{m_i}$ and $n_j$, i.e., $$t_{i,j}=\text{index}(p_{m_i}, n_j) \tag{45}$$

The quantization or granularity $\Delta p_m=p_{m_i}-p_{m_{i-1}}$ and $\Delta n=n_j-n_{j-1}$, respectively, must be chosen experimentally such that the differences of the values index pertaining to two adjacent operating points does not exceed one. In other words with equation (45), $$|t_{i,j}-t_{i-1,j}|\leqq 1 \text{ and } |t_{i,j}-t_{i,j-1}|\leqq 1 \text{ and } |t_{i,j}-t_{i-1,j-1}|\leqq 1 \forall i,j \tag{46}$$

For a given vehicle type, the table values $t_{i,j}$ can be calibrated off-line for each table grid point $(p_{m_i}, n_j)$ by either using the "trial and error" method or by applying probing and calculating method of equation (37). For any given operating point $(p_m(t_k), n(t_k))$ the table value is scheduled such that it corresponds to the closest grid point $(p_{m_i}, n_j)$. To provide a formalized description of the scheduling mechanism let $S_p=(p_{m_1}, p_{m_2}, p_{m_3}, \ldots p_{m_n})$ and $S_n=(n_1, n_2, n_3, \ldots, n_m)$ denote the well ordered countable sets of grid points on the pressure and the speed axis, respectively, and define the ordinal number for each element $x_i$ of a well ordered countable set $S_x=(x_1, x_2, \ldots, x_i, \ldots, x_p)$ as $$\text{ord}(x_i)=i \tag{47}$$

Furthermore assume that $x_i \leqq x(t_k) < x_{i+1}$ and define $$\text{round}(x(t_k)) = \begin{cases} x_i & \text{if } \dfrac{|x(t_k)-x_i|}{|x_{i+1}-x_i|} < 0.5 \\ x_{i+1} & \text{else} \end{cases} \tag{48}$$

Then for each operating point $(p_m(t_k), n(t_k))$ the table values index are scheduled as follows:

$$\left.\begin{aligned} i &= \text{ord}(\text{round}(p_s(t_k))) \\ j &= \text{ord}(\text{round}(n(t_k))) \end{aligned}\right\} \Rightarrow \text{index} = t_{i,j} \tag{49}$$

Conversely, after a probing sequence under steady state engine operating conditions (characterized by a operating point $(p_m(t_k), n(t_k))$) the new evaluated value index is used to update the table value corresponding to the closest grid point $(p_{m_i}, n_j)$, that is, in formalized notation:

$$\left.\begin{array}{l} i = \mathrm{ord}(\mathrm{round}(p_s(t_k))) \\ j = \mathrm{ord}(\mathrm{round}(n(t_k))) \end{array}\right\} \Rightarrow t_{i,j} = \mathrm{index} \tag{50}$$

Figure 4:
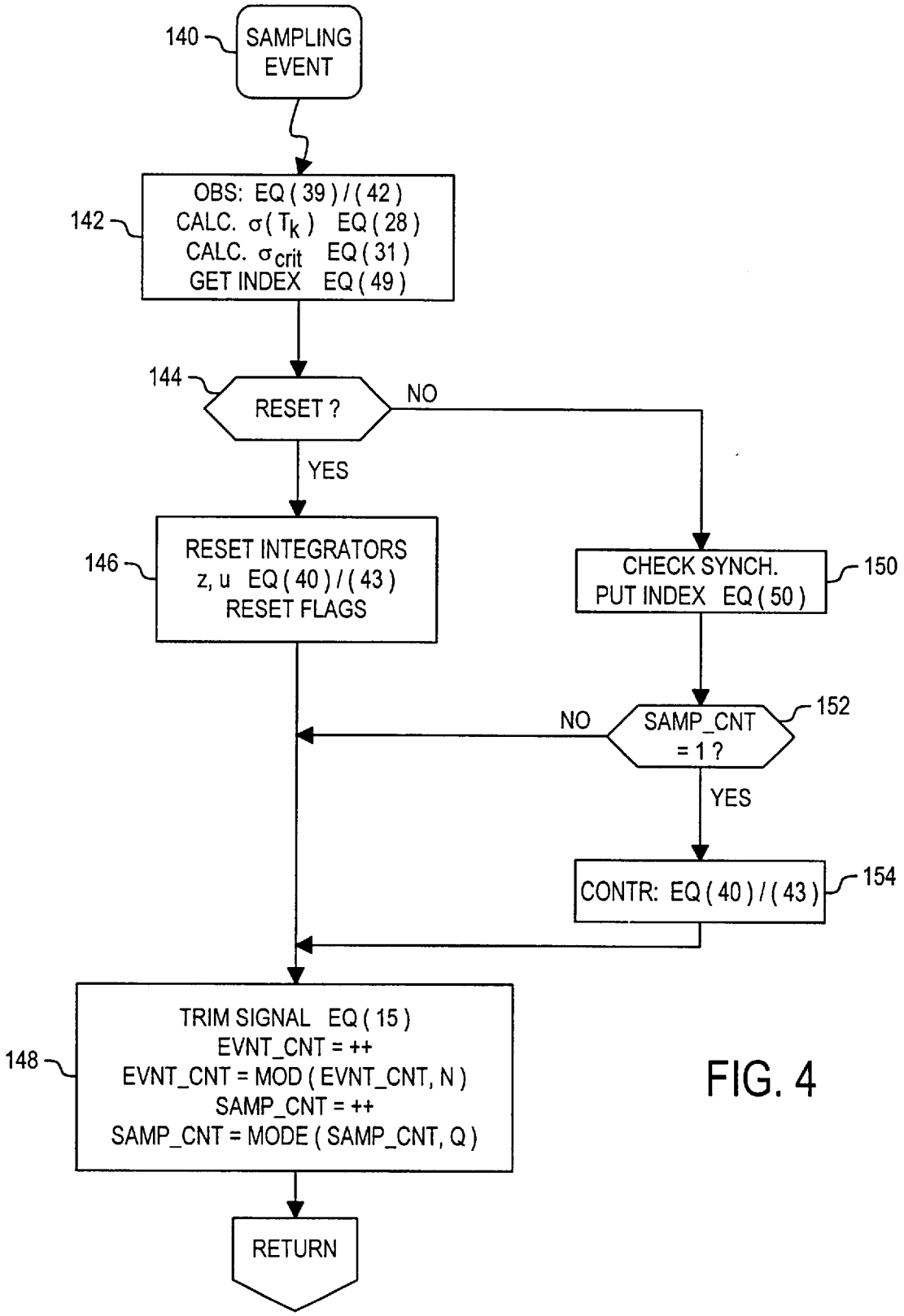

The above-described control is summarized by the flow diagram of FIG. 4, which represents computer program instructions executed by the engine controller 52 of FIG. 2. The control is initialized at engine start-up by setting an emergency reset flag (reset) for all integrator state variables, and resetting a sample counter variable (samp cnt) used to identify sampling events that coincide with a firing event. At each sampling event, the blocks 142–154 are executed as shown. The block 142 updates the observer equation (39) or (42) depending on whether probing is in effect, calculates the performance measure $\sigma(t_k)$ and its critical value using equations (28) and (31), and gets the index value by table look up per equation (49). Initially, the reset flag (checked at block 144) will be set, and blocks 146–148 are executed. Block 146 resets the controller integrators z, u and flags, while block 148 updates the trim variable $\upsilon(t_k)$ using equation (15) and updates the system counter variables. If the reset flag is not set, the block 150 is executed to check for phase offset (using either the trial-and-error or probing methods), and to re-evaluate the index value using equation (50). Block 152 then checks the status of the sample counter variable, and block 154 updates the controller terms accordingly.

In summary, the present invention provides a method of achieving individual cylinder air/fuel control based on sampled readings of a single oxygen sensor responsive to the combined exhaust gas flow of several engine cylinders, using a model-based observer to reproduce the imbalances of the different cylinders and a proportional-plus-integral controller is used for their elimination. While this invention has been described in reference to the illustrated embodiment, it is expected that various modifications in addition to those suggested above will occur to those skilled in the art. In this regard, it will be understood that the scope of this invention is not limited to the illustrated embodiment, and that fuel controls incorporating such modifications may fall within the scope of this invention, which is defined by the appended claims.

What is claimed is:

1. A control method for fueling N individual cylinders of a multi-cylinder internal combustion engine based on an output signal of an oxygen sensor positioned to respond to a combination of exhaust gases generated in the individual cylinders, the control method comprising the steps of:

sampling the oxygen sensor output signal sampling events that occur in synchronism with firing events in each of the individual cylinders;

filtering the oxygen sensor signal samples to define a nominal air/fuel ratio trajectory;

utilizing an observer model to define N state variables estimating air/fuel imbalances in each of the N different cylinders, and an additional state variable estimating a deviation of the sensed A/F ratio from said nominal air/fuel ratio trajectory;

measuring a deviation of the sensed air/fuel ratio from the nominal air/fuel ratio trajectory at each sampling event, and updating all of the state variables based on a difference between such measured deviation and the estimated deviation given by said additional state variable;

retrieving a previously stored index that associates the N state variables with corresponding individual cylinders;

fueling the individual cylinders based on the associated observer state variables using a closed-loop feedback control;

computing a control performance measure based on a sum of the indicated air/fuel ratio imbalances; and if the performance measure indicates unstable air/fuel ratio control, identifying a new index value associating the N state variables with the individual cylinders, and storing the new index value in place of the retrieved index.

2. The control method of claim 1, wherein nominal air/fuel ratio trajectory is filtered over a plurality of engine cycles.

3. The control method of claim 1, wherein unstable air/fuel ratio control is indicated when at least a predefined increase in the performance measure is detected.

4. The control method of claim 1, wherein the observer model includes both the oxygen sensor and mixing of the exhaust gases upstream of the oxygen sensor.

5. The control method of claim 1, wherein the observer model and the closed-loop feedback control are both represented as a rotational system.

6. The control method of claim 1, wherein the step of identifying a new index value comprises the steps of:

temporarily disabling the closed-loop feedback control;

superimposing a periodic probing signal on the fuel supplied to a single cylinder over an even number of firing events under steady state operation of the engine;

monitoring the N state variables to identify a maximal response to the probing signal; and identifying the new index value based on the identified maximal response.

* * * * *